United States Patent [19]

McCloud

[11] 4,217,847

[45] Aug. 19, 1980

[54] SELF-RELEASE CAM CLEAT

[76] Inventor: Robert A. McCloud, 17982 Walnut Rd., Castro Valley, Calif. 94546

[21] Appl. No.: 918,925

[22] Filed: Jun. 26, 1978

[51] Int. Cl.[2] ..... B63B 21/08

[52] U.S. Cl. ..... 114/218; 24/134 KB; 114/199; 188/65.1

[58] Field of Search ..... 114/218, 101, 199; 254/138; 24/134 KB, 134 L, 134 P; 188/65.1, 65.2

[56] References Cited

U.S. PATENT DOCUMENTS

| | | | |
|---|---|---|---|
| 407,592 | 7/1889 | Harkness | 24/134 KB |
| 4,084,532 | 4/1978 | Feder | 114/218 |

FOREIGN PATENT DOCUMENTS

| | | | |
|---|---|---|---|
| 1338789 | 8/1963 | France | 114/218 |

*Primary Examiner*—Charles E. Frankfort
*Attorney, Agent, or Firm*—John F. O'Flaherty

[57] ABSTRACT

A rope holding device including an improved cam cleat useful on a sailboat for maintaining sail ropes taut. The improved cam cleat contains two cam-type jaws to grip the rope, one of which has a serrated or tooth-like surface for gripping, while the other has a smooth gripping surface which permits easy rotation of the smooth cam member to the release position. The smooth cam member has an arcuate face with a radius of curvature for the gripping surface substantially greater than the smooth face of the release surface adjacent it. Consequently, when the smooth release cam is pivoted so that the retained rope is slipped from the smooth gripping surface to the smooth release surface, the rope is automatically released without the need for the operator to exert a force on the rope to pull it away from the cam cleat as is usually done.

5 Claims, 6 Drawing Figures

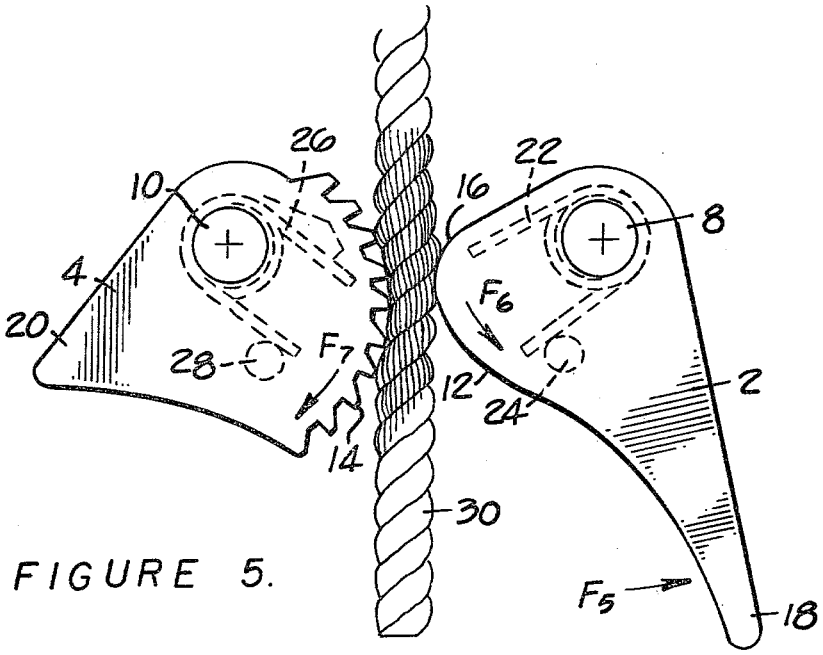
FIGURE 5.
FIGURE 6.
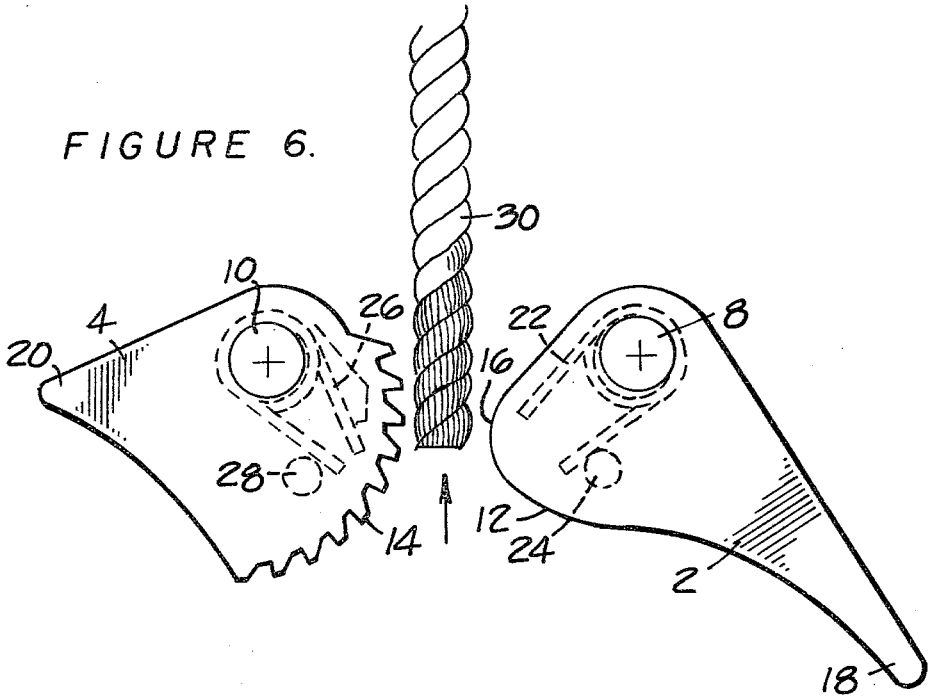

SELF-RELEASE CAM CLEAT

BACKGROUND OF THE INVENTION

This invention relates to cleats generally used on sailing craft for holding ropes such as a sail sheet and more particularly it relates to cam cleats which have pivotable eccentric cams between which the rope is placed and which is secured by its own tension.

In conventional cleats, the rope is jammed between the eccentric pivotable members with the greater the tension exerted on the rope, the greater the force exerted by the cam cleats on the rope. The cam cleats are usually both serrated so as to prevent the slippage of the rope through the cleats in the direction of tension. In order to release such a sheet, the operator must pull the rope further through the cleats in the direction opposite the tension to relieve some of the force being exerted by the eccentric cams on the rope, and then lift the rope out of the cleats in a direction normal to the rope tension. Under certain sailing conditions, when there is great line tension on the rope, it is very difficult for a crewman to pull the rope against such line tension and jerk it up and out of the cam cleat, especially if the crewman is not positioned directly behind the cam cleat where he can use his weight to pull and jerk the rope.

It is desirable, especially when sailing in competition, to be able to release a sail sheet from a cam cleat from any position, and to do it quickly and with a minimum amount of jerk.

Consequently, it is the object of this invention to provide a self-releasing cam cleat which does not require a heavy pulling on the rope against the line tension in order to release it.

It is another object of this invention to provide a cam cleat which may be released from any position.

It is another object of this invention to provide a cam cleat which does not require additional release mechanisms such as levers or very intricate shapes but rather, is made up of a pair of cams generally attached to a base plate.

SUMMARY OF THE INVENTION

These and other objects are accomplished by providing a pair of pivotably mounted cam members through which a rope may be inserted and which pivot to exert a force against the rope as tension on the rope is increased.

One of the cam members has a serrated or toothed surface to better grip the rope and prevent slippage. However, the opposite cam member has a smooth gripping surface which exerts force against the rope by pressing it against the opposite toothed cam, but itself having a low coefficient of friction so its arcuate surface may be moved along the rope to a release surface, having a substantially smaller radius. Upon pivoting of the smooth surface cam so the rope is in contact with the release surface, the toothed cam is also rotated by the gripped rope. At a point where the rope is no longer gripped by the toothed face of the toothed cam, and is also at the smooth release surface of the non-toothed cam, the tension on the line would generally be sufficient for the rope to be automatically released or it may be gently and quickly removed from the cam cleat.

BRIEF DESCRIPTION OF THE DRAWINGS

FIGS. 3–6 are plan views showing the cam cleat in operation at various stages of insertion and release of a rope.

Turning to FIG. 1, cam cleats 2 and 4 are pivotably mounted on base plate 6, via suitable fastening means such as screw at 8 and 10 respectively. The base plate in turn may be mounted on the hull of a boat by suitable means such as a screw (not shown) through hole 11. The smooth surface cam 2 has a smooth surface face 12 for gripping the rope as well as forcing it against the toothed gripping surface 14 of a non-smooth surface cam 4. Smooth surface cam 2, also has a smooth release surface, 16, which has a substantially smaller radius than the smooth gripping surface 12. Finger piece 18, is provided to permit the pivoting of the smooth surface cam from the smooth gripping surface to the smooth release surface. Also, the toothed cam, 4, may be so shaped to provide finger piece 20 for pivoting the cam. Both cams are spring biased with stops, as best seen in FIGS. 3–6.

Turning to FIG. 2, the preferred shape of both the smooth and non-smooth cams are shown. The smooth gripping surface has a radius of curvature R, which extends generally from the pivot point 8, to the gripping surface, as shown by the arrow marked R in FIG. 2. However, so as to provide eccentricity, it need not have its center at the pivot point 8. However, the radius center should be in close proximity to the pivot point or center 8 and generally of equal radius. The radius center for the smooth surface gripping cam should generally be substantially closer to the pivot center than the center of radius, $R_c$ of the toothed cam. The toothed cam has a radius of curvature $R_c$ measured from a point, as shown by the arrow $R_c$ of FIG. 2, which is substantially greater than radius $R_1$ measured from the pivot center of the non-smooth cam as shown by the arrow $R_1$. Consequently, the toothed cam has a substantially greater amount of eccentricity so as to grip the rope against its serrated surfaces, tighter as tension increases on the rope. While the rope is in the gripped position, that portion of the toothed cam arc, $\theta$ and that portion of the arc of the smooth gripping surface, $\phi$ contact the rope. The toothed and smooth gripping surfaces are shaped so that $\theta$ and $\phi$ are between 15° and 30°. The entire smooth gripping surface having a radius substantially equal to R, is contemplated to be in an arc $\alpha$ of approximately 60°. Adjacent the smooth cam gripping surface is a smooth release surface having a radius $R_o$ substantially less than radius R, as shown by arrow R in FIG. 2. In the preferred embodiment, it is contemplated that $R_o$ is at least one-half R, so as to provide a substantially narrower arc in the release surface than the gripping surface. Also, the arc of the release surface $\Omega$, as measured from the pivot center, is approximately 30°.

Turning to FIG. 3, line 30 is shown being inserted in the direction of arrow, that direction being opposite the direction of the tension on the rope. In order to facilitate the insertion of the rope, toothed cam 4 is pivoted by applying a force in the direction at $F_1$. This force is opposite the force exerted by leaf spring 26, which is biased against stop 28. Smooth surface cam 4 is spring biased by leaf spring 22, against stop 24. It should be understood that any type biasing mechanism, such as a leaf spring or a coil spring may be used to bias the cam members against the rope. After the rope is inserted between the cam members, the force $F_1$ is released. The spring biased cam member then pivots in an opposite direction $F_2$, which in turn moves the toothed portion 14 against the rope with a force $F_3$. Force $F_3$, along with the tension on the rope, transmits to the smooth surface cam a force $F_4$, the force $F_4$ also being in the same direction as the force transmitted by spring 22. As previously discussed with respect to FIG. 2, the gripped rope will generally have a surface arc contacted by both the toothed and smooth cam of approximately 15° to 30°. It will be understood that as the tension on the rope is increased, opposite the direction of insertion as shown in FIG. 3, the cam surfaces will be caused to rotate further in a direction $F_3$ and $F_4$. The eccentric cams, especially toothed cam $F_3$, upon further rotation will squeeze the rope tighter, thus preventing slippage upon increased tension on the rope.

Turning to FIG. 5, the rope may be released by placing firm and steady pressure on finger piece 18, with a force and in the direction shown at $F_5$. The force $F_5$ then causes the smooth surface cam to pivot in the direction of the arrow shown at $F_6$. The pivoting of smooth surface cam 4, in the direction of $F_6$, will result in a certain amount of slippage of the smooth face against the tightly clamped rope, and will also result in pulling the rope tighter against the direction of tension. To the extent that the smooth surface 12 does not slip, and causes rope 30 to be pulled tighter, the force $F_6$ will be transmitted through the rope causing the toothed gripping cam 14 to rotate in the direction $F_7$ until the rope no longer contacts the toothed surface as shown in FIG. 6. At the point where the rope no longer contacts the toothed surface, and contacts the release surface of the smooth surface cam, the tension on the rope will generally be sufficient to pull the rope through the cam surfaces. Or, at this point, the rope can be gently lifted away from the cams without any jerking or pressure on the rope.

Figure 1:
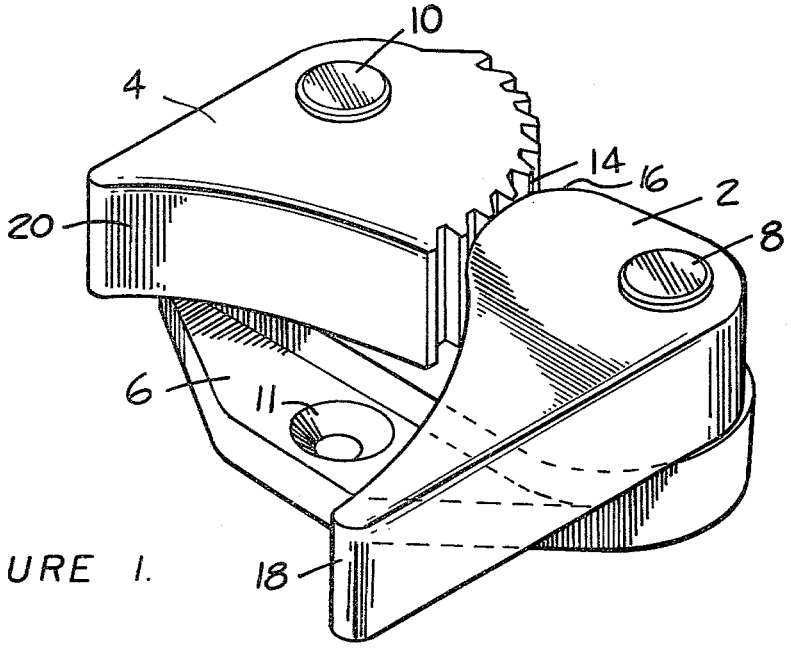
FIG. 1 is a perspective view of the cam cleat with base.
Figure 2:
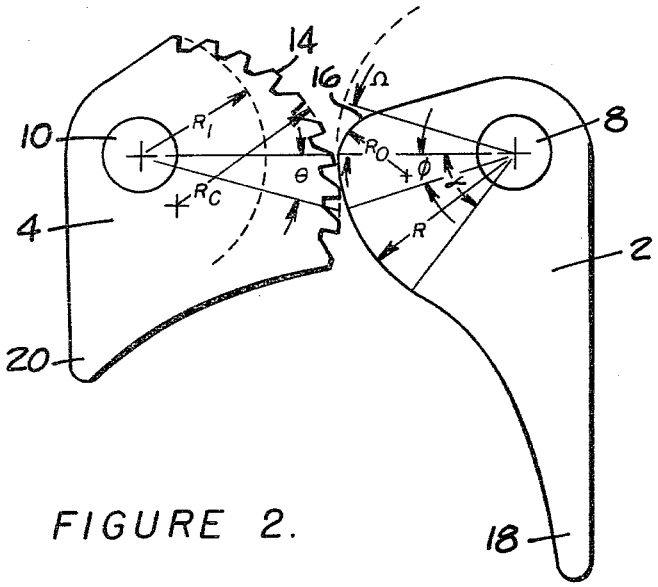
FIG. 2 is a plan view of the cam cleats showing the radius of curvature of both the toothed and smooth gripping surfaces as well as the arcuate angle of such surfaces.
Figure 3:
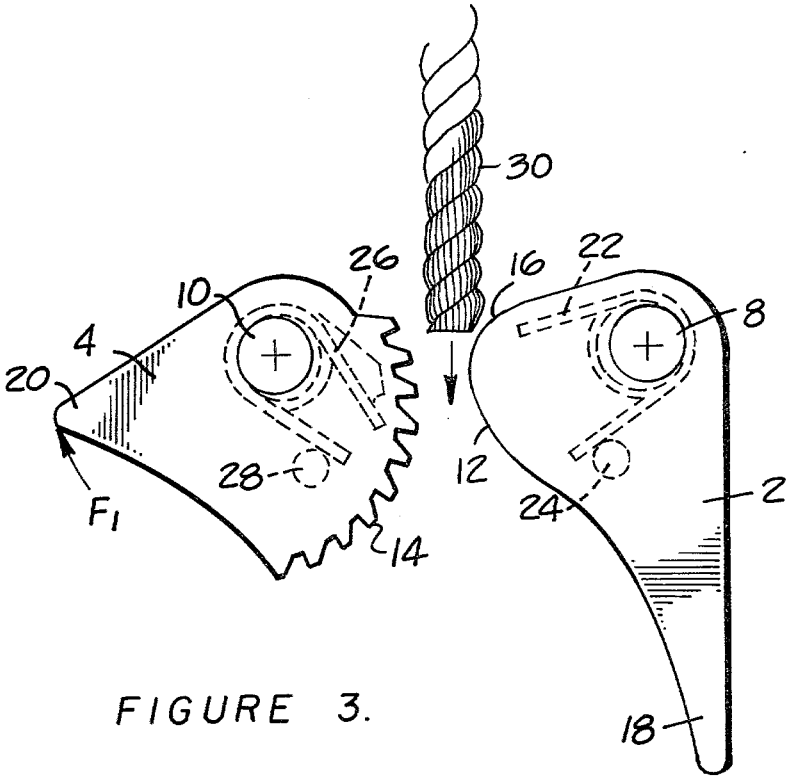
Figure 4:
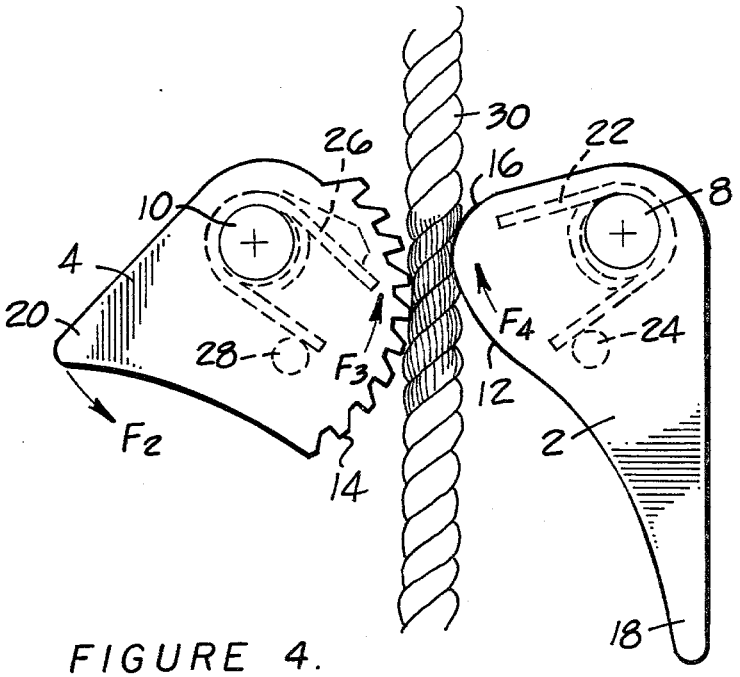

It will be seen from the insertion and release of the rope, that finger pressure at $F_1$ and at $F_5$ during the cycle is all that is required. A sailor generally need not be positioned in any particular place to exert sufficient pressure on $F_5$, to cause the smooth surface cam to slip past the rope and move it further inward to cause the toothed cam to rotate so as to loosen its grip. Surprisingly, I have found that unlike most prior art cams which teach the use of two toothed or serrated surfaces, by properly dimensioning the smooth surface cam, sufficient pressure is exerted to grip a rope, even under extremely high tensions experienced in the sailing of vessels. As can best be seen in FIG. 2, the radius R must be sufficiently large, and must be of sufficient arc, $\phi$ to exert sufficient pressure on the rope without slippage. It would be obvious that if radius R decreases more quickly, and approaches $R_o$ over a shorter arc, it is easier to pivot and release the rope. However, I have found that the smooth gripping surface must be dimensioned with the radius approximately that of R over a sufficient arc to allow adequate gripping of the rope. Also, it will be understood that if radius R along the gripping surface increases substantially, such as the increase in radius from $R_1$ to $R_c$ for the more eccentric toothed cam, then it would be very difficult with finger pressure to pivot the cam from the gripping to the release surface. Although it will be understood that R and $R_c$ need not be constant, they should be such that when in the gripping position, approximately 15° to 30° arc along the gripping face contacts the rope. If the arc angles $\theta$ and $\phi$ are increased substantially greater than this, then the rope will slip through the cams as the tension is increased. On the other hand, if the arc of the gripping surface is substantially decreased so that very little surface is contacting the rope, then the smooth surface cam may toggle past the pitch point onto the release surface, allowing the rope to release.

I claim:

1. A release cam cleat comprising:

a base plate suitable for mounting;

a pair of oppositely disposed cam members, pivotably mounted and spring biased on said plate;

one of said cam members having a non-smooth surface for gripping a rope, the non-smooth surface having a radius of curvature greater than the pivot radius such that said cam surface is eccentric so that upon pivoting in the spring biased direction, the distance between the pair of cam members decreases;

the opposite cam member having smooth gripping and release surfaces and a release lever, said smooth gripping surface having a radius approximately equal to the pivot radius and being substantially less eccentric than the non-smooth gripping surface and said release surface having a radius substantially less than the pivot radius so as to provide a substantially narrower arc than the smooth gripping surface and said release surface being adjacent said gripping surface in the direction opposite the free end of a gripped rope such that upon pivoting said smooth surface cam member via said release lever in the direction opposite the spring bias, the rope will release upon loss of contact with said gripping surface and contact with said release surface.

2. The release cam cleat of claim 1, wherein the release surface radius of the smooth surface cam is less than one-half the radius of the smooth gripping surface.

3. The release cam cleat of claim 1, wherein the radius of curvature of the gripping surface of each cam provide between 15° to 30° gripping contact arc when measured from the pivot points to said surfaces.

4. The release cam cleat of claim 1, wherein the release surface arc of the smooth surface cam is approximately one-half the gripping surface arc of the smooth surface cam when measured from the pivot points to said surfaces.

5. The release cam cleat of claim 4, wherein the release surface arc is approximately 30° and the gripping surface arc is approximately 60°.

* * * * *